US007287647B1

(12) United States Patent
Licciardi

(10) Patent No.: US 7,287,647 B1
(45) Date of Patent: Oct. 30, 2007

(54) BINGO CARRYING CASE FOR PROVIDING PRIVACY DURING GAME PLAY

(76) Inventor: Lisa M. Licciardi, 165 Percival Rd., East Falmouth, MA (US) 02536

( * ) Notice: Subject to any disclaimer, the term of this patent is extended or adjusted under 35 U.S.C. 154(b) by 362 days.

(21) Appl. No.: 10/979,035

(22) Filed: Nov. 2, 2004

(51) Int. Cl.
*B65D 71/00* (2006.01)

(52) U.S. Cl. ..... 206/579; 206/315.1

(58) Field of Classification Search ..... 206/45.24, 206/315.1, 570, 575, 576, 579, 764; 273/148 A, 273/309

See application file for complete search history.

(56) References Cited

U.S. PATENT DOCUMENTS 4,255,872 A * 3/1981 Williams, Sr. ..... 434/308
4,893,711 A * 1/1990 Gustafson ..... 206/45.24
4,948,139 A * 8/1990 Heeszel ..... 273/148 A
D311,227 S 10/1990 Rotondo
5,028,048 A * 7/1991 Watson et al. ..... 273/148 A
5,054,783 A 10/1991 Hull et al.
5,120,069 A 6/1992 Shaw
D332,466 S * 1/1993 Logan ..... D19/36
5,224,602 A * 7/1993 Bettles et al. ..... 206/579
5,495,947 A 3/1996 Zarske
5,813,445 A 9/1998 Christman
5,868,246 A 2/1999 Westfall et al.
6,082,545 A * 7/2000 Ford et al. ..... 206/579
6,126,012 A * 10/2000 Roegner ..... 206/579
6,189,594 B1 * 2/2001 Carter ..... 160/135

* cited by examiner

*Primary Examiner*—David T. Fidei

(57) ABSTRACT

An apparatus for transporting a player's bingo paraphernalia includes a carrying case including pivotally connected first and second members selectively movable between open and closed positions. The present invention preferably includes a mechanism for maintaining the carrying case at a substantially vertical position when the first and second members are adapted to the open position. The carrying case further includes a latching member having male and female portions secured to the first and second member respectively such that the carrying case can be effectively maintained at a closed position during transportation thereof. A storing mechanism includes a plurality of fold-out stands pivotally connected to the first and second members such that the fold-out stands can be respectively swiveled along selected arcuate paths between operating and non-operating positions.

15 Claims, 2 Drawing Sheets

BINGO CARRYING CASE FOR PROVIDING PRIVACY DURING GAME PLAY

CROSS REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to carrying cases and, more particularly, to a bingo carrying case for providing privacy while playing bingo.

2. Prior Art

The phenomenal increase of participation in the past few years in the game of bingo has created an interest on the part of the present inventors to solve the multiple problems connected with bingo and the present invention addresses the problems of transportation, weight, convenience, organization, playing surface, card holding means, marker availability, etc., which the prior art has not satisfactorily solved.

The game of bingo is enjoyed by individuals of all ages and is widely played at various establishments, such as churches, clubs, or the like. Playing bingo requires the use of bingo cards, bingo markers, magnetic wands, daubers (special large markers in various colors which are utilized in playing paper bingo games), pencils, tablets, or the like. In addition, bingo players also carry to the bingo game items such as eye glasses, food, candy, beverages, umbrella, keys, purse, wallet, good luck charms, etc. It is cumbersome to carry several bags containing all of these items, and is difficult to easily locate a particular item mixed in with all of the other bingo accessories.

Accordingly, a need remains for a carrying case for transporting a player's bingo paraphernalia that may be used to provide privacy to a player while playing and to overcome the above noted shortcomings. The present invention satisfies such a need by providing a bingo carrying case that is movable between open and closed positions and may be maintained at an elevated position for providing privacy to a user. Such a case allows a player to easily transport all the items needed to the bingo hall in a compact and organized manner. The carrying case provides easy access to all items needed to play bingo and also provides a privacy screen for obstructing the view of other players who might want to look at a player's bingo card in order to track a user's progress. This would be especially appreciated by players who play more than one card at a time.

BRIEF SUMMARY OF THE INVENTION

In view of the foregoing background, it is therefore an object of the present invention to provide a bingo carrying case for providing privacy while playing bingo. These and other objects, features, and advantages of the invention are provided by an apparatus for transporting a player's bingo paraphernalia and for providing a barrier such that the player's paraphernalia become hidden from adjacently positioned players during game play.

The apparatus includes a carrying case including pivotally connected first and second members selectively movable between open and closed positions. The first and second members preferably further include a plurality of bottom surfaces and a plurality of outer walls extending away from the bottom surfaces respectively. The outer walls block a line of sight traveling along a periphery of the first and second members and define a private play area situated between the first and second members. The carrying case preferably further includes a plurality of handles having opposed end portions attached thereto for assisting the player to transport the apparatus between remote locations.

A hinge member is operably connected to a selected portion of the outer walls such that the hinge member terminates above a support surface on which the carrying case is positioned. The present invention preferably includes a mechanism for maintaining the carrying case at a substantially vertical position when the first and second members are adapted to the open position. The carrying case preferably further includes a latching member having male and female portions secured to the first and second member respectively such that the carrying case can be effectively maintained at a closed position during transportation thereof. A mechanism for storing the paraphernalia at elevated positions may be included such that the paraphernalia can be selectively moved between operating and non-operating positions without passing beyond the privacy area.

The storing mechanism preferably includes a plurality of fold-out stands pivotally connected to the first and second members such that the fold-out stands can be respectively swiveled along selected arcuate paths between operating and non-operating positions. The fold-out stands preferably include first and second members extending substantially orthogonal to each other respectively wherein the second members are positionable outwardly and away from the bottom surfaces for preventing the carrying case from moving beyond equilibrium. The fold-out stands are situated subjacent the hinge member.

The supporting mechanism preferably includes a plurality of pockets secured to one of the bottom surfaces and spaced apart at predetermined distances therealong. A plurality of pouches are preferably juxtaposed subjacent the pockets for housing a plurality of daubers respectively. The present invention also preferably includes a pouch having an opaque surface provided with a zipper for storing money and personal items therein.

The supporting mechanism preferably further includes a cup holder including top and bottom portions secured to one of the bottom surfaces and pivotally connected thereto respectively. The bottom portion is selectively positionable between raised and lowered positions for supporting a beverage container thereon during operating conditions. The cup holder preferably further includes a fastening member positionable over at least one section of the top and bottom portions for assisting to maintain the cup holder at the raised position during non-operating conditions.

It is noted the purpose of the foregoing abstract is to enable the U.S. Patent and Trademark Office and the public generally, especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

Figure 1:
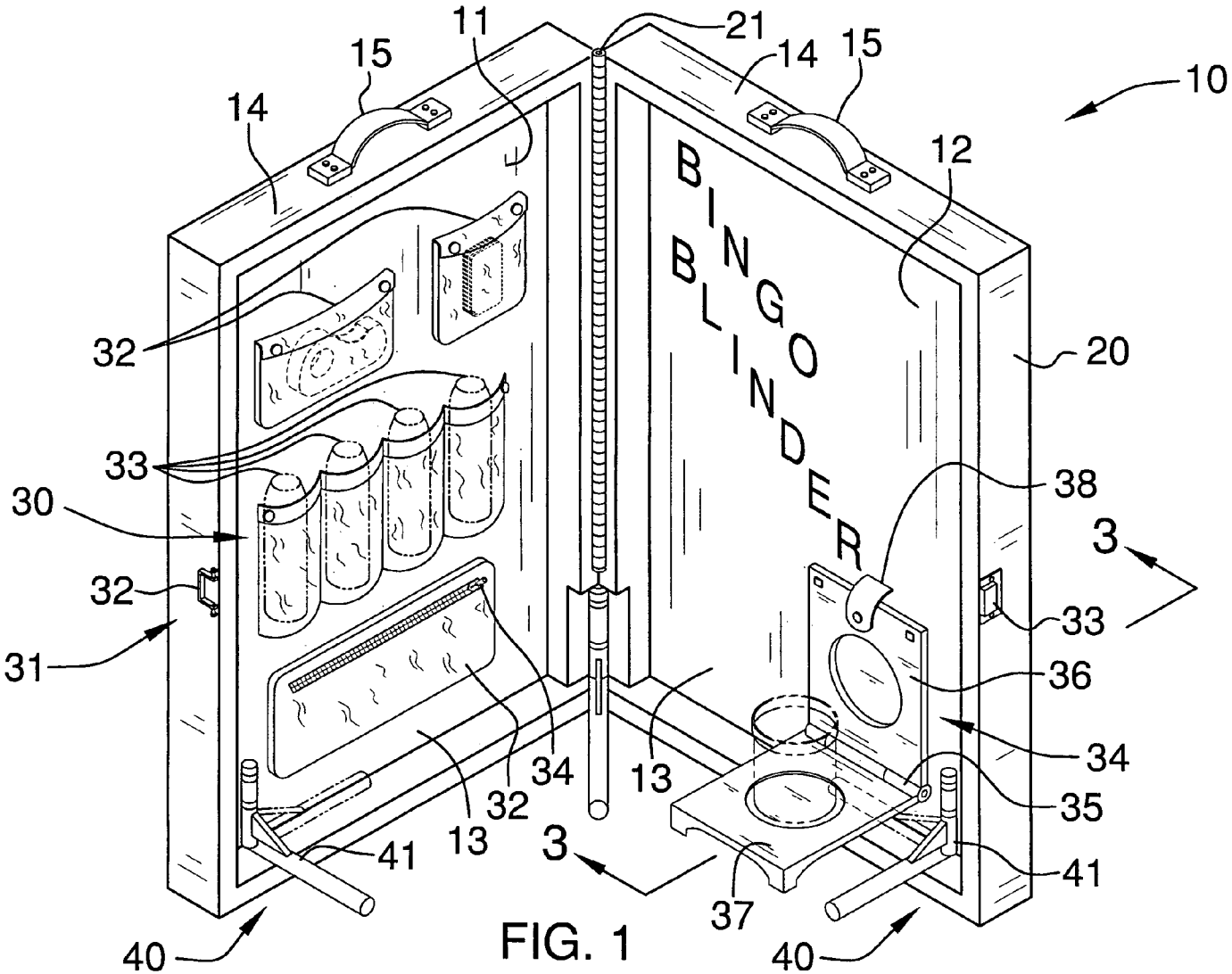
FIG. 1 is a perspective view showing the carrying case at an open position, in accordance with the present invention.
Figure 2:
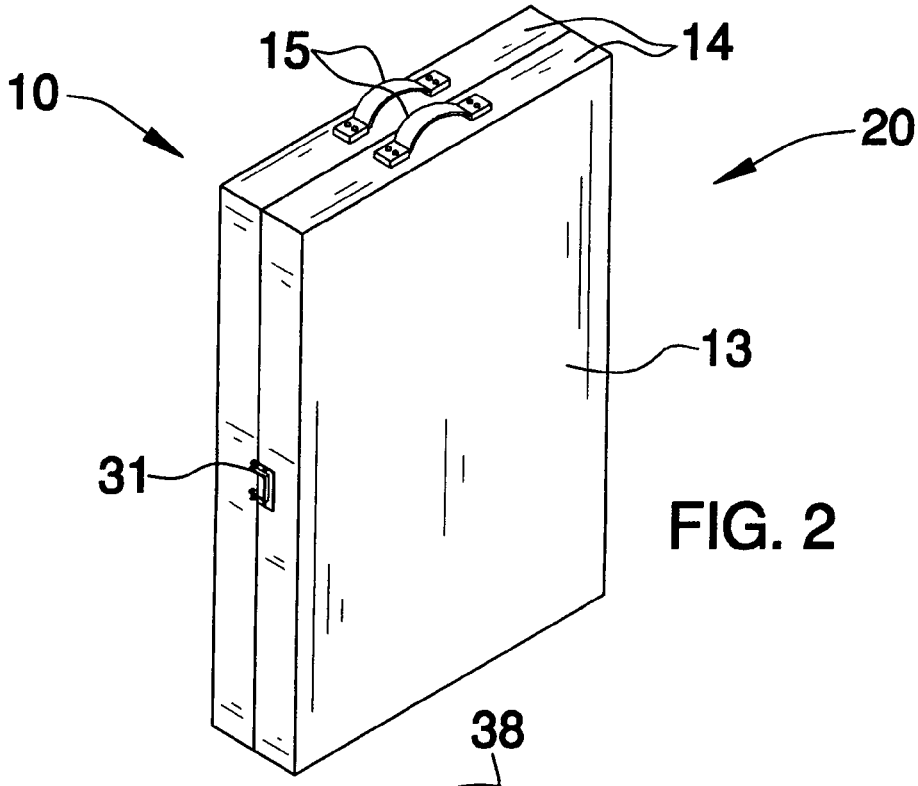
FIG. 2 is a perspective view of the carrying case, at a closed position.
Figure 3:
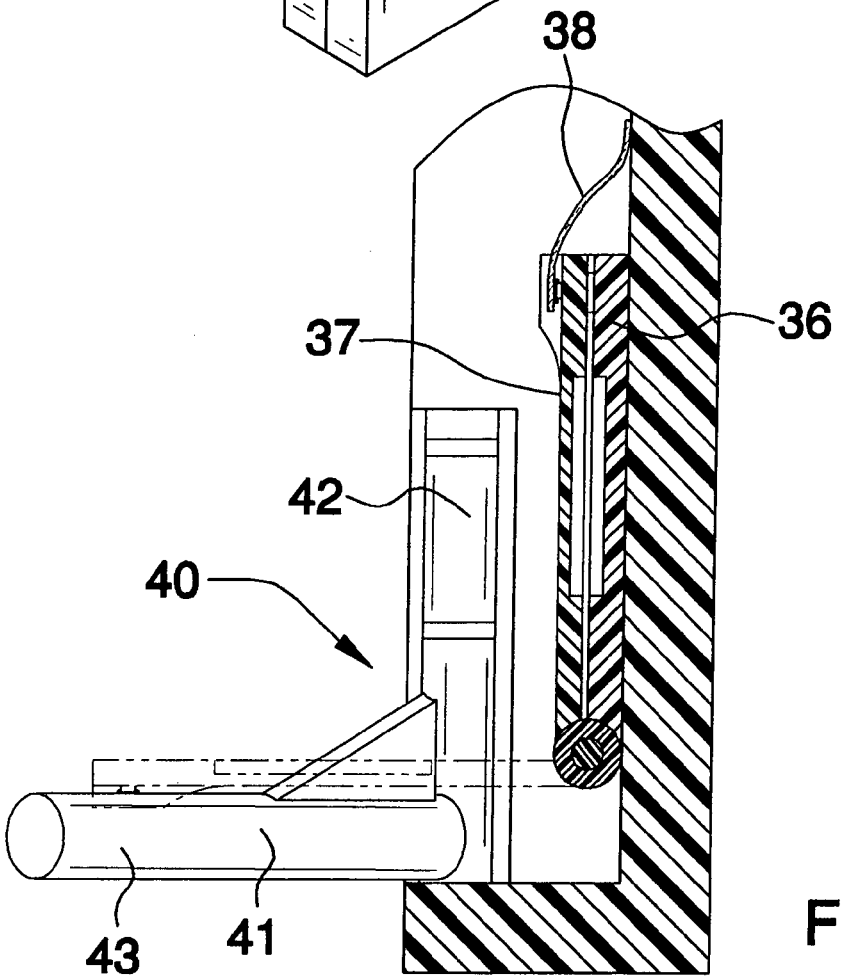
FIG. 3 is a cross-sectional view of the carrying case showing the fold-out stands, taken along line 3-3.

The apparatus of this invention is referred to generally in FIGS. 1-3 by the reference numeral 10 and is intended to provide an apparatus for transporting a player's bingo paraphernalia. It should be understood that the apparatus 10 may be used to transport paraphernalia for many different games and should not be limited to only bingo.

Initially referring to FIG. 1, the apparatus 10 includes a carrying case 20 for transporting a player's bingo paraphernalia and for providing a barrier such that the player's paraphernalia become hidden from adjacently positioned players during game play. The carrying case 20 preferably further includes pivotally connected first 11 and second 12 members selectively movable between open and closed positions.

The first 11 and second 12 members further include a plurality of bottom surfaces 13 and a plurality of outer walls 14 extending away from the bottom surfaces 13 respectively. The outer walls 14 block a line of sight traveling along a periphery of the first 11 and second 12 members and define a private play area situated between the first 11 and second 12 members so that opposing players are unable to see a player's card. The carrying case 20 preferably further includes a plurality of handles 15 having opposed end portions attached thereto for assisting the player to transport the apparatus 10 between remote locations.

A hinge member 21 is operably connected to a selected portion of the outer walls 14 such that the hinge member 21 terminates above a support surface on which the carrying case 20 is positioned. The present invention preferably includes a mechanism 30 for maintaining the carrying case 20 at a substantially vertical position when the first 11 and second 12 members are adapted to the open position.

The carrying case 20 may further include a latching member 31 having male 32 and female 33 portions secured to the first 11 and second 12 member respectively such that the carrying case 20 can be effectively maintained at a closed position during transportation thereof, as shown in FIG. 2. This advantageously ensures that paraphernalia does not become lost during travel to and from games. A mechanism 40 for storing the paraphernalia at elevated positions may also be included such that the paraphernalia can be selectively moved between operating and non-operating positions without passing beyond the privacy area, as shown in FIG. 3.

Referring to FIGS. 1 and 3, the storing mechanism 40 includes a plurality of fold-out stands 41 pivotally connected to the first 11 and second 12 members such that the fold-out stands can be respectively swiveled along selected arcuate paths between operating and non-operating positions. The fold-out stands 41 preferably include first 42 and second members 43 extending substantially orthogonal to each other respectively wherein the second members 43 are positionable outwardly and away from the bottom surfaces 13 for preventing the carrying case 20 from moving beyond equilibrium. The stands provide stability to the elevated carrying case, preventing it from falling over if bumped by an adjacent player or spectator. The fold-out stands 41 are preferably situated subjacent the hinge member 21.

Referring to FIG. 1, the supporting mechanism 30 preferably includes a plurality of pockets 31 secured to one of the bottom surfaces 13 and spaced apart at predetermined distances therealong. A plurality of pouches 32 are preferably juxtaposed subjacent the pockets 31 for housing a plurality of daubers 33 respectively. The present invention also preferably includes a pouch 32 having an opaque surface provided with a zipper 34 for storing money and personal items therein, as shown in FIG. 1. The opaque surface ensures that other players cannot see the amount of money maintained therein, increasing security and privacy.

Still referring to FIG. 1, the supporting mechanism 30 preferably further includes a cup holder 34 including top 36 and bottom 37 portions secured to one of the bottom surfaces 13 and pivotally connected thereto respectively. The bottom portion 37 is selectively positionable between raised and lowered positions for supporting a beverage container thereon during operating conditions. The cup holder 34 preferably further includes a fastening member 38 positionable over at least one section of the top 36 and bottom 37 portions for assisting to maintain the cup holder 34 at the raised position during non-operating conditions. The cup holder 34 advantageously allows a user to position his/her drink in a convenient, easy to reach location, without having to worry about it spilling.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. An apparatus for transporting a player's bingo paraphernalia and for providing a barrier such that the player's paraphernalia become hidden from adjacently positioned players during game play, said apparatus comprising:

a carrying case including pivotally connected first and second members selectively movable between open and closed positions, said first and second members further including a plurality of bottom surfaces and a plurality of outer walls extending away from said bottom surfaces respectively, said outer walls for blocking a line of sight traveling along a periphery of said first and second members and for defining a private play area situated between said first and second members;

a hinge member operably connected to a selected portion of said outer walls such that said hinge member terminates above a support surface on which said carrying case is positioned;

means for maintaining said carrying case at a substantially vertical position when said first and second members are adapted to the open position; and means for storing the paraphernalia at elevated positions such that the paraphernalia can be selectively moved between operating and non-operating positions without passing beyond the privacy area;

wherein said maintaining means comprises a plurality of fold-out stands pivotally connected to said first and second members such that said fold-out stands can be respectively swiveled along selected arcuate paths between operating and non-operating positions, said fold-out stands including first and second members extending substantially orthogonal to each other respectively wherein said second members are positionable outwardly and away from said bottom surfaces for preventing said carrying case from moving beyond equilibrium.

2. The apparatus of claim 1, wherein said supporting means comprises:

a plurality of pockets secured to one said bottom surfaces and spaced apart at predetermined distances thereal-ong;

a plurality of pouches juxtaposed subjacent said pockets for housing a plurality of daubers respectively; and a pouch having an opaque surface provided with a zipper for storing money and personal items therein.

3. The apparatus of claim 1, wherein one said fold-out stands is situated subjacent said hinge member.

4. The apparatus of claim 1, wherein said supporting means further comprises:

a cup holder including top and bottom portions secured to one said bottom surfaces and pivotally connected thereto respectively, said bottom portion being selectively positionable between raised and lowered positions for supporting a beverage container thereon during operating conditions, said cup holder further including a fastening member positionable over at least one section of said top and bottom portions for assisting to maintain said cup holder at the raised position during non-operating conditions.

5. The apparatus of claim 1, wherein said carrying case further comprises:

a latching member having male and female portions secured to said first and second member respectively such that said carrying case can be effectively maintained at a closed position during transportation thereof.

6. An apparatus for transporting a player's bingo paraphernalia and for providing a barrier such that the player's paraphernalia become hidden from adjacently positioned players during game play, said apparatus comprising:

a carrying case including pivotally connected first and second members selectively movable between open and closed positions, said first and second members further including a plurality of bottom surfaces and a plurality of outer walls extending away from said bottom surfaces respectively, said outer walls for blocking a line of sight traveling along a periphery of said first and second members and for defining a private play area situated between said first and second members, said carrying case further including a plurality of handles having opposed end portions attached thereto for assisting the player to transport said apparatus between remote locations;

a hinge member operably connected to a selected portion of said outer walls such that said hinge member terminates above a support surface on which said carrying case is positioned;

means for maintaining said carrying case at a substantially vertical position when said first and second members are adapted to the open position; and means for storing the paraphernalia at elevated positions such that the paraphernalia can be selectively moved between operating and non-operating positions without passing beyond the privacy area;

wherein said supporting means comprises a plurality of pockets secured to one said bottom surfaces and spaced apart at predetermined distances thereal-ong;

a plurality of pouches juxtaposed subjacent said pockets for housing a plurality of daubers respectively; and a pouch having an opaque surface provided with a zipper for storing money and personal items therein.

7. The apparatus of claim 6, wherein said maintaining means comprises:

a plurality of fold-out stands pivotally connected to said first and second members such that said fold-out stands can be respectively swiveled along selected arcuate paths between operating and non-operating positions, said fold-out stands including first and second members extending substantially orthogonal to each other respectively wherein said second members are positionable outwardly and away from said bottom surfaces for preventing said carrying case from moving beyond equilibrium.

8. The apparatus of claim 7, wherein one said fold-out stands is situated subjacent said hinge member.

9. The apparatus of claim 6, wherein said supporting means further comprises:

a cup holder including top and bottom portions secured to one said bottom surfaces and pivotally connected thereto respectively, said bottom portion being selectively positionable between raised and lowered positions for supporting a beverage container thereon during operating conditions, said cup holder further including a fastening member positionable over at least one section of said top and bottom portions for assisting to maintain said cup holder at the raised position during non-operating conditions.

10. The apparatus of claim 6, wherein said carrying case further comprises:

a latching member having male and female portions secured to said first and second member respectively such that said carrying case can be effectively maintained at a closed position during transportation thereof.

11. An apparatus for transporting a player's bingo paraphernalia and for providing a barrier such that the player's paraphernalia become hidden from adjacently positioned players during game play, said apparatus comprising:

a carrying case including pivotally connected first and second members selectively movable between open and closed positions, said first and second members further including a plurality of bottom surfaces and a plurality of outer walls extending away from said bottom surfaces respectively, said outer walls for blocking a line of sight traveling along a periphery of said first and second members and for defining a private play area situated between said first and second members, said carrying case further including a plurality of handles having opposed end portions attached thereto for assisting the player to transport said apparatus between remote locations, said handles being situated above said bottom surface and spaced apart when said carrying case is moved to a closed position;

a hinge member operably connected to a selected portion of said outer walls such that said hinge member terminates above a support surface on which said carrying case is positioned;

means for maintaining said carrying case at a substantially vertical position when said first and second members are adapted to the open position; and means for storing the paraphernalia at elevated positions such that the paraphernalia can be selectively moved between operating and non-operating positions without passing beyond the privacy area;

wherein said supporting means further comprises a cup holder including top and bottom portions secured to one said bottom surfaces and pivotally connected thereto respectively, said bottom portion being selectively positionable between raised and lowered positions for supporting a beverage container thereon during operating conditions, said cup holder further including a fastening member positionable over at least one section of said top and bottom portions for assisting to maintain said cup holder at the raised position during non-operating conditions.

12. The apparatus of claim 11, wherein said maintaining means comprises:

a plurality of fold-out stands pivotally connected to said first and second members such that said fold-out stands can be respectively swiveled along selected arcuate paths between operating and non-operating positions, said fold-out stands including first and second members extending substantially orthogonal to each other respectively wherein said second members are positionable outwardly and away from said bottom surfaces for preventing said carrying case from moving beyond equilibrium.

13. The apparatus of claim 11, wherein said supporting means comprises:

a plurality of pockets secured to one said bottom surfaces and spaced apart at predetermined distances therealong;

a plurality of pouches juxtaposed subjacent said pockets for housing a plurality of daubers respectively; and a pouch having an opaque surface provided with a zipper for storing money and personal items therein.

14. The apparatus of claim 12, wherein one said fold-out stands is situated subjacent said hinge member.

15. The apparatus of claim 11, wherein said carrying case further comprises:

a latching member having male and female portions secured to said first and second member respectively such that said carrying case can be effectively maintained at a closed position during transportation thereof.

* * * * *